United States Patent [19]

Jansen-Herfeld

[11] Patent Number: 4,682,525

[45] Date of Patent: Jul. 28, 1987

[54] HYDRAULIC SAW FRAME WITH EXTERNAL SEALING MEANS

[75] Inventor: Roettger Jansen-Herfeld, Remscheid, Fed. Rep. of Germany

[73] Assignee: Richard Jansen GmbH, Remscheid, Fed. Rep. of Germany

[21] Appl. No.: 856,772

[22] Filed: Apr. 24, 1986

[30] Foreign Application Priority Data

Apr. 24, 1985 [DE] Fed. Rep. of Germany ..... 3514728

[51] Int. Cl.[4] ..... B27B 3/34

[52] U.S. Cl. ..... 83/751; 83/639; 83/746; 83/783; 83/786

[58] Field of Search ..... 83/639, 786, 751, 783, 83/784, 746; 277/212 FB, DIG. 4

[56] References Cited

U.S. PATENT DOCUMENTS

| | | | |
|---|---|---|---|
| 3,998,466 | 12/1976 | Kondo | 277/DIG. 4 |
| 4,327,925 | 5/1982 | Alexander et al. | 277/212 FB |
| 4,407,517 | 10/1983 | Neyer | 277/212 FB |

FOREIGN PATENT DOCUMENTS

| | | | |
|---|---|---|---|
| 0046977 | 3/1982 | European Pat. Off. | 83/751 |
| 3234500 | 3/1984 | Fed. Rep. of Germany | 83/783 |

*Primary Examiner*—Donald R. Schran
*Attorney, Agent, or Firm*—Michael J. Striker

[57] ABSTRACT

A hydraulic gang saw frame is provided with an elastic sealing sheet covering the entire top side of hydraulic cylinder and piston units for stretching saw blades. The pistons pass through openings in center portion of the sealing sheet and are firmly connected through latter. The preferred portion of the sheet covers at least three lateral sides of the frame. The elastic deformation of the sheet is such as to permit full strokes of the pistons.

4 Claims, 1 Drawing Figure

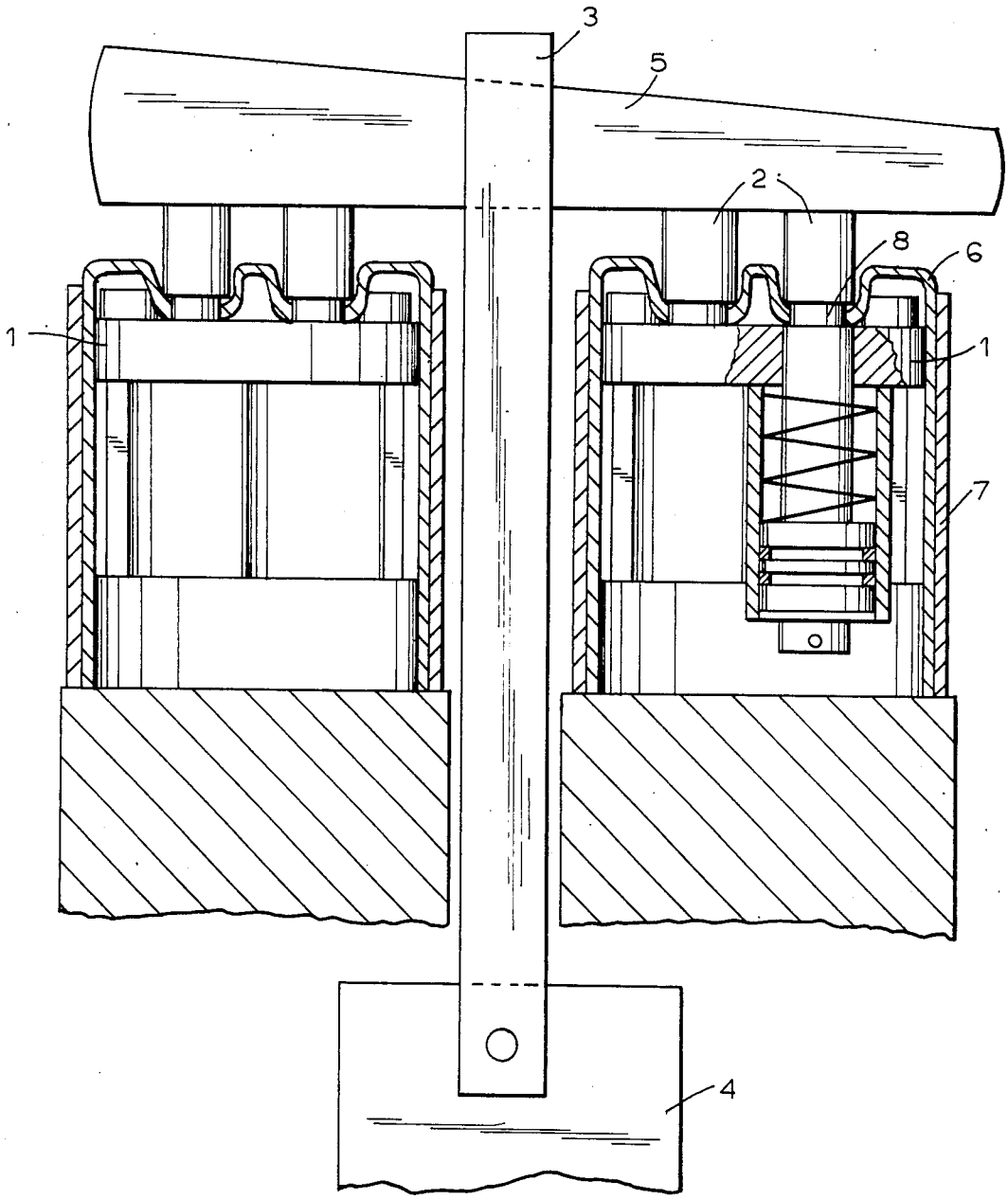
3
5
2
8
6
1
1
7
4

HYDRAULIC SAW FRAME WITH EXTERNAL SEALING MEANS

BACKGROUND OF THE INVENTION

The present invention relates to a hydraulic saw frame of the type which includes a frame body, a plurality of hydraulic cylinder and piston units arranged in a row on said frame and acting on a movable stretching member connected to one end of saw blades.

Conventional hydraulic gang saw frames have the disadvantage that the external parts of hydraulic units are unprotected against water and dirt. Consequently, the pistons are subject to rust and prone to seizing inasmuch as the tolerances between the piston and the guide in the cylinder must very narrow to withstand high oil pressures.

SUMMARY OF THE INVENTION

It is therefore a general object of the present invention to avoid this advantage.

In particular, it is an object of this invention to provide an improved saw frame which even under extremely adverse operational conditions as regards the effect of water and dirt guarantee smooth strokes of the pistons at minimum losses due to friction.

In keeping with this object and others which will become apparent hereafter, one feature of this invention resides in the provision of protective sealing sheet which extends over the entire length of the saw frame so as to cover the same at least from three sides and leaves open only the side at which the saw frame is pressed against a machine frame. According to the invention, to allow full strokes of the piston, the top of each piston penetrates through the sheet and is firmly attached to the same in such a manner that the sheet forms in the region of the attachment a conical extension which is elastically deformable according to the different positions of the pistons. To prevent penetration of water or dirt in the range of the openings in the elastic sealing sheet, the pistons are provided with a cicumferential groove whereby the diameter of the openings in the sheet is smaller than that of the annular groove. Consequently, due to elastic contraction of the sheet there is provided a tight seal around the tip of the piston rod.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE illustrates schematically a sectional side view of the hydraulic saw stretching frame of this invention.

DESCRIPTION OF THE PREFERRED EMBODIMENT

The saw frame of which only a part is illustrated in the drawing, supports a stretching device 1 in the form of a plurality of hydraulic cylinder and piston units whose pistons 2 act on a wedge shaped stretching member 5. The wedge 5 is connected via a tang rod 3 to one end of a saw blade 4 to stretch the same during the stroke of the pistons. The stretching device is covered from at least three sides by an elastic sealing sheet 6 whose center portion is provided with openings tightly engaging circumferential grooves 8 in the upper part of the rods of pistons 2. The peripheral portion of each sealing sheet 6 is sealing secured to lateral sides of the frame body, preferably by lateral pressure plates 7.

The elasticity of the material of sealing sheets 6 is sufficient to permit elastic deformation over the whole stroke of the pistons.

While the invention has been illustrated and described as embodied in a specific example of a hydraulic saw frame, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hydraulic saw frame including a frame body, a movable member supporting one end of at least saw blade, at least one stretching device arranged on said frame body and including a plurality of hydraulic cylinder and piston units arranged in a row to act on said movable member, and elastic sealing sheet enclosing all cylinder and piston units of said stretching device, said sealing sheet having a center portion secured to respective pistons of said hydraulic units and a peripheral portion secured to said frame body, said sealing sheet being elastically deformable over the length of displacement of said pistons.

2. A hydraulic saw frame as defined in claim 1, wherein each of said pistons has a piston rod whose upper part is provided with a circumferential groove, and said center portion of said sealing sheet being formed with holes for elastically engaging said grooves.

3. A hydraulic saw frame as defined in claim 1, wherein said peripheral portion of said sealing sheet is pressed against lateral walls of said stretching device by pressure plates.

4. A hydraulic saw frame as defined in claim 1, wherein said elastic sealing sheet completely covers said cylinder and piston units in the direction of said row and said peripheral portion covering at least three lateral sides of said stretching device.

* * * * *